US006550834B2

(12) United States Patent
Fromelius

(10) Patent No.: US 6,550,834 B2
(45) Date of Patent: Apr. 22, 2003

(54) REMOVABLE INSERT FOR CREATING A VOID SPACE, AS IN PRECAST CONCRETE PANELS

(76) Inventor: Lawrence Fromelius, 1713 N. 2479 Rd., Ottawa, IL (US) 61350

( * ) Notice: Subject to any disclaimer, the term of this patent is extended or adjusted under 35 U.S.C. 154(b) by 0 days.

(21) Appl. No.: 09/728,502

(22) Filed: Nov. 30, 2000

(65) Prior Publication Data

US 2002/0062604 A1 May 30, 2002

(51) Int. Cl.[7] ..... E04G 15/04

(52) U.S. Cl. ..... 294/89; 52/125.5; 52/704; 52/707

(58) Field of Search ..... 294/1.1, 89, 82.1, 294/82.24, 82.31; 249/94, 177, 178; 52/125.1, 125.2, 125.4, 125.5, 704, 707, 708

(56) References Cited

U.S. PATENT DOCUMENTS

| | | | | | |
|---|---|---|---|---|---|
| 2,422,839 | A | | 6/1947 | Maskey | 294/83 |
| 2,842,822 | A | | 7/1958 | Bennett | 24/73 |
| 3,550,343 | A | * | 12/1970 | Buske | 52/704 |
| 4,296,909 | A | * | 10/1981 | Haeussler | 294/89 |
| 4,367,892 | A | * | 1/1983 | Holt | 294/89 |
| 4,437,272 | A | * | 3/1984 | Johnson | 52/125.5 |
| 4,437,642 | A | * | 3/1984 | Holt | 249/175 |
| 4,580,378 | A | * | 4/1986 | Kelly et al. | 52/125.5 |
| 4,603,522 | A | * | 8/1986 | Johnson | 52/125.4 |
| 4,627,198 | A | | 12/1986 | Francies, III | 294/89 |
| 4,671,554 | A | * | 6/1987 | Lancelot | 294/89 |
| 4,700,979 | A | | 10/1987 | Courtois et al. | 294/89 |
| 4,807,843 | A | * | 2/1989 | Courtois et al. | 294/89 |
| 4,821,994 | A | * | 4/1989 | Fricker | 249/91 |
| 5,226,265 | A | | 7/1993 | Kelly et al. | 52/125.6 |
| 5,528,867 | A | * | 6/1996 | Thompson | 52/125.5 |
| 5,857,296 | A | | 1/1999 | Niday et al. | 52/125.1 |
| 6,341,452 | B1 | * | 1/2002 | Bollinghaus | 52/125.5 |

* cited by examiner

*Primary Examiner*—Eileen D. Lillis
*Assistant Examiner*—Paul T. Chin
(74) *Attorney, Agent, or Firm*—Baniak Pine & Gannon

(57) ABSTRACT

A removable and reusable insert assembly for positioning and supporting a lifting system within a panel to be formed from cast concrete, the insert assembly having a left and right portion which are detachably removable from each other, and a lid that is secured over the insert. The lid protects an interior space of the insert assembly.

14 Claims, 3 Drawing Sheets

REMOVABLE INSERT FOR CREATING A VOID SPACE, AS IN PRECAST CONCRETE PANELS

FIELD OF THE INVENTION

The present invention relates to inserts used to make void spaces in a cast material, such as in precast concrete panels, and more particularly for use in setting and protecting engineered lifting systems that are to be embedded within the precast concrete panels.

DESCRIPTION OF THE PRIOR ART

Prestressed, precast concrete panels are widely popular in the building and construction industry. Large, heavy concrete panels typically require a lifting element(s) to be embedded within the panel so they can be readily moved, and arranged at the construction site. It has been a past practice to provide inserts that are positionable within the concrete panels prior to casting, to thereby form holes, depressions, or other desired geometrical void configurations, within the panels once the concrete has cured.

Inserts have also been used in conjunction with engineered lifting systems, where the inserts are to be permanently embedded within the concrete panels. The inserts in that application are designed to hold or support the lifting system as the concrete cures, and to leave a depression in the cured panel which facilitates access to the lifting system so that lifting hooks and/or cables can be directly connected to the lifting system without interference from part of the concrete panel.

Setting of an insert typically involves the use of pins and various angle-iron supports to position the inserts in a desired location and to facilitate removal of the inserts with a minimum of difficulty. However, there are several existing problems related to the inserts presently available; some inserts are not easily positionable; others fail or inadequately protect the lifting system during casting; many are difficult to remove after the concrete has cured; most inserts have a very low level of reusability. The removal and reusability problems are very much related, in that typically, the insert assembly will become bonded to the concrete, making the removal both time consuming and difficult, and usually destroying the integrity of the insert so that it cannot be used again. Some damage may even result to the casting itself.

It can be appreciated that based on the above-described problems, there still exists a long-felt need to provide a concrete insert which can overcome the difficulties and problems mentioned above.

SUMMARY OF THE INVENTION

It is a primary aspect of the invention to provide an improved insert that is to be used in connection with an element or assembly where the latter is to be permanently set within the casting. The insert of the present invention thus comprises in one embodiment, a base assembly having an exterior surface defining the shape of the void space to be created, with an interior space having an opening through which the element extends, an access opening through which the interior space is accessed, and a cover over the access opening which closes and protects the interior space, and the element extending therein. In a preferred embodiment, the base assembly, the interior space and the bottom opening are adapted for temporarily receiving a lifting element, such as a hook, that is to be set into a precast concrete panel, and a lid for protecting the interior space of the base assembly.

It is another aspect of the invention to provide an insert wherein the base assembly is non-destructibly removable from the cast material. This reusable insert advantageously includes a pair of movable flaps for assisting removal of the insert after the cast material is set.

It is yet another aspect of the invention to provide an insert assembly wherein the lid is provided with at least one, and preferably a pair of spaced holes, each hole for receiving a positioning plate therethrough for positioning of the insert.

It is still another aspect of the invention to provide an insert assembly wherein the lifting mechanism utilizes a rod, and the insert includes arcuate wall brackets integrally formed therein for receiving the rod of the lifting hook assembly that is to be set into the panel.

The features and advantages of the invention will be further understood upon consideration of the following detailed description of an embodiment of the invention taken in conjunction with the drawings, in which:

DETAILED DESCRIPTION OF A PREFERRED EMBODIMENT OF THE INVENTION

Figure 1:
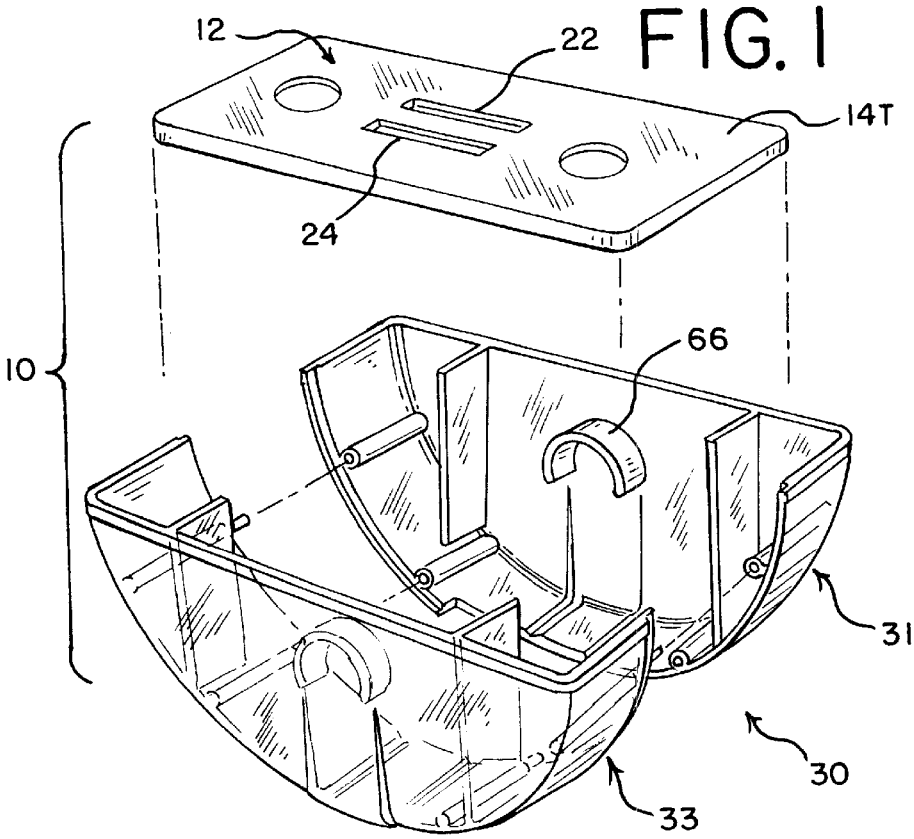
FIG. 1 is an exploded view of a plastic concrete insert assembly formed in accordance with the invention.

For purposes of promoting and understanding of the principles of the invention, reference will now be made to a preferred embodiment illustrated in the drawings, and specific language will be used to describe the same. It will nevertheless be understood that no limitation of the scope of the invention is thereby intended, there being contemplated such alterations and modifications of the illustrative device, in such further applications of the principles of the invention as disclosed herein, as would normally occur to one skilled in the art to which the invention pertains.

Referring to FIGS. 1–4, a preferred embodiment of an insert assembly is identified at 10. The assembly generally comprises a lid 12 and a cooperating base assembly 30. The base assembly 30 is formed of a first or right portion 31, and a second or left portion 33 that are connected together by a snap-fit connection, as will be explained later herein. The left and right portions 31, 33 are essentially mirror images to the other, except for two variations which relate to how they are joined together, and which will be specifically highlighted. Therefore, only the right portion 31 will be explained in greater detail, and it should be understood that like elements will also be referred to with like references characters for both portions.

As seen, right portion 31 is comprised of a vertical wall 34 having an inside surface 36 and outside surface 38 and a top edge surface 40. The vertical wall 34 is integrally connected to the arcuate wall 42 which is disposed perpendicular to vertical wall 34. Arcuate wall 42 includes the inside end 44, the outside end 46, and the top edge surface 48. The arcuate wall 42. and vertical wall 34 share the integral edge 50 which is the connection point between the two walls. The outside end 46 of arcuate wall 42 includes the joining edge 52 which is formed by the undercut 56 extending along the entire outside end 46, thus creating the lip surface 58.

The right portion 31 also includes laterally spaced cylindrical pin receptor housings 60 which are essentially solid, cylindrical members having a blind bore 62 formed therein. Each cylindrical pin receptor housing extends from the edge of lip surface 58 to inside surface 36 of wall 34, terminating at the integral edge 50. One difference between the left portion 31 and the right portion 33 involves the cylindrical pin receptor housing 60. On the left portion 33, instead of the cylindrical pin receptor housings 60 being provided with blind bores, the cylindrical pin receptor housings are solid and they further include a projecting cylindrical protuberance or pin 65. The respective cylindrical pins 65 are all identical and of a diametric size which is readily received within a respective blind bore 62 on the right portion 31.

The right and left portions 31, 33 each include the vertically disposed stiffeners 64 that are opposed from each other when the two portions are connected together. Centered between each portion's respective stiffener 64 is an arcuate bracket 66 that is formed from a semi-circular wall 68 which has an interior surface 69 and exterior surface 71. The wall forms opening 70 that faces arcuate wall 42. The vertical wall 34 also includes an indentation 74 formed into inside surface 36. The indentation 74 has a vertical height 75 and a horizontal extent 77, wherein the horizontal extent 77 is approximately equivalent to an outer diameter of arcuate bracket 66. The indentation 74 is provided to facilitate insertion and removal of a pin element that forms part of a lifting system which is to be embedded in the concrete; this aspect will be explained later. The arcuate wall 42 also includes a movable flap 78, coextensive with the indentation 74, particularly along horizontal extent 77. The movable flap 78 is formed by a pair of laterally spaced, V-shaped indentations 80 that are stamped into the inside surface 44 of arcuate wall 42. The movable flap 78 has a horizontal extent 82 that is identical or substantially equivalent to the horizontal extent 77 of indentation 74. The right portion 31 also includes a recess 84 formed in arcuate wall 42. The recess is defined by the short side walls 86 and the interconnecting long side wall 88. Likewise, the left portion 30 will include an identical recess. When the left and right portions 31, 33 are connected together, they will form a rectangular opening 90 which is centered within the base assembly 30.

Figure 2:
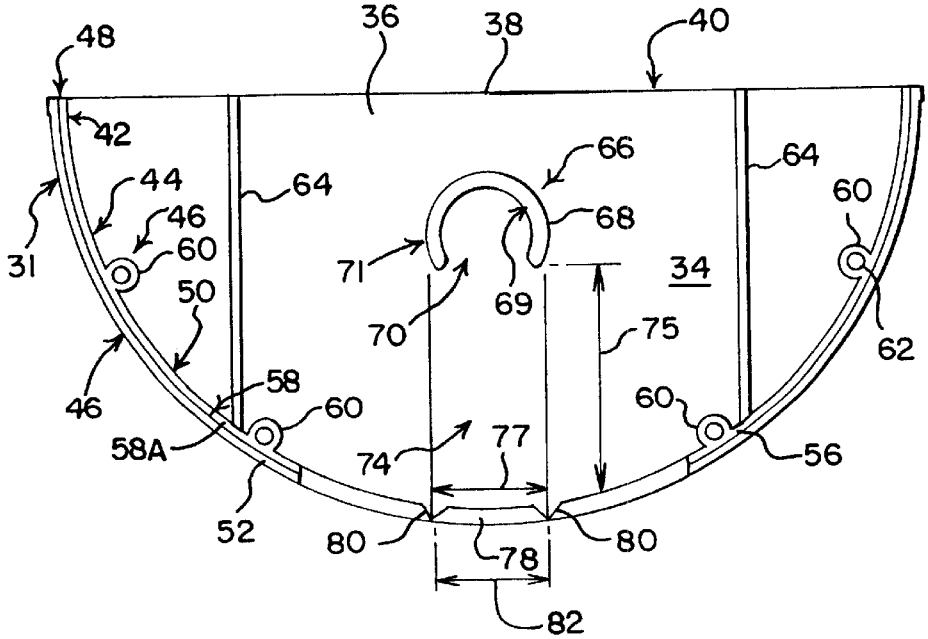
FIG. 2. is a plan view of the interior of the right portion of the insert of FIG. 1.
Figure 3:
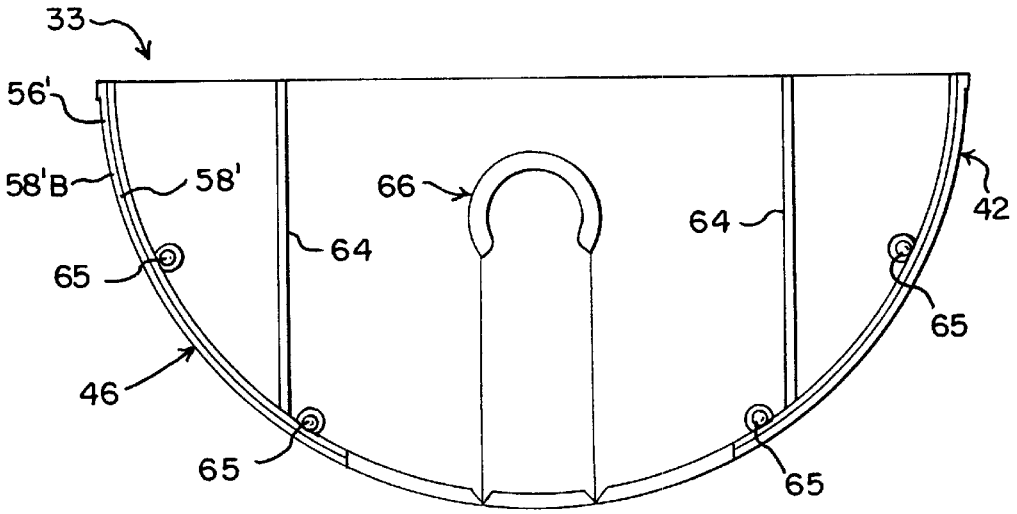
FIG. 3 is a plan view of the interior of the left portion of the insert of FIG. 1.
Figure 4:
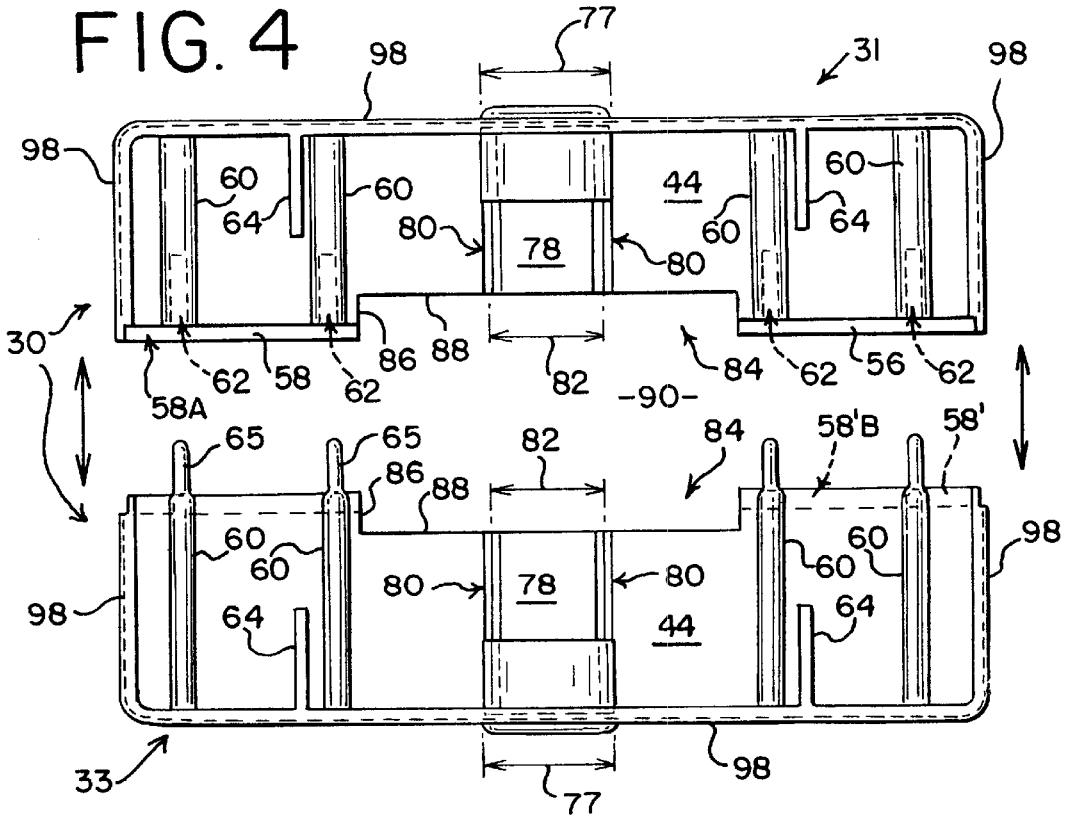
FIG. 4 is a top view of both portions of the base assembly of FIG. 1.

One other noteworthy difference between the first portion 31 and the second portion 33 is that the first or right portion 31 is formed with an undercut 56 in the face of the inside surface 44 on arcuate wall 42 to create a bottom lip 58 having the lip surface 58A (e.g., FIG. 2). However, the second or left portion 33 also includes a matching undercut 56', but the undercut 56' is formed into the outside surface 46 of the arcuate wall 42 of that portion (e.g., FIG. 3), thereby creating a top lip 58' having a lip surface 58'B. When left and right portions 31 and 33 are to be joined together, the cylindrical pins 65 are inserted into the blind bores 62, and the lip surfaces 58A and 58'B complementarily superimpose such that the top and bottom lips 58 and 58' form a connection joint.

The left and right portions 31, 33, each include an identical peripheral ledge 98 (FIG. 4) that is located adjacent the top edge 40 and which extends or projects away from the respective outside surfaces 38, 46 of walls 34 and 42. When the two sections are joined together, the peripheral ledge 98 extends continuously about the perimeter of the base assembly to accept the lid 12 in a snap-fit fashion.

Figure 5:
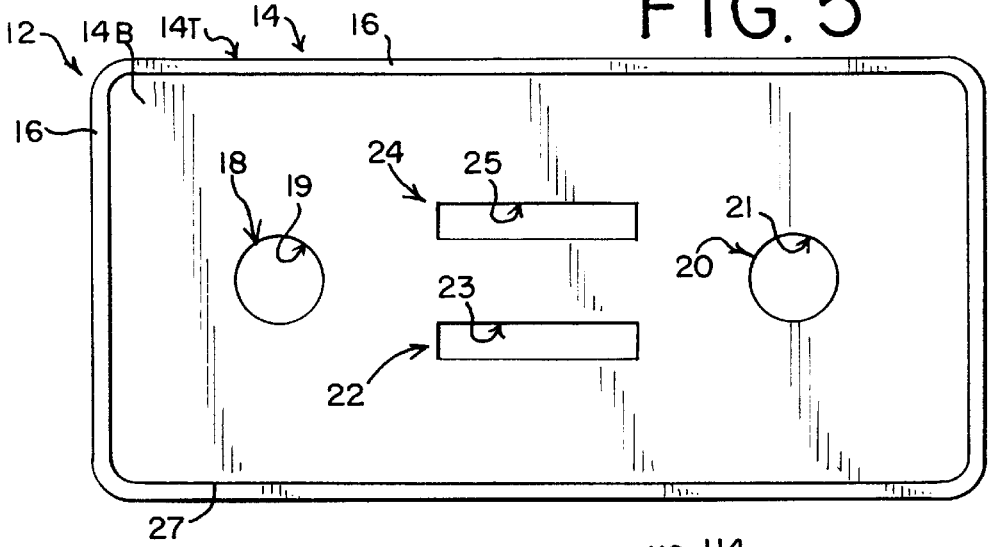
FIG. 5 is a bottom view of the lid of the insert assembly of FIG. 1.

Turning attention to FIG. 5, the lid 12 is illustrated, and it generally comprises a rectangularly configured member having a top and a bottom planar wall surface 14T, 14B, and a downwardly projecting perimeter rim 16 that is disposed perpendicular to the surface 14B. The bottom surface 14B is shown with the lip 16 projecting out the plane of the paper towards a viewer in FIG. 5. The lid 12 includes a first circular hole 18 that is defined by the edge surface 19, and a second circular hole 20 that is defined by edge surface 21. These are finger (or pry) holes for the cover. Disposed between each of the holes 18 and 20, are a pair of rectangular slots 22 and 24 that are arranged parallel to each other. As seen, slot 22 is delimited by the surface 23, while slot 24 is delimited by the surface 25. The perimeter rim 16 also includes small lip 27 integrally formed therein, which projects towards the interior of the lid. The lip 27 snaps underneath the peripheral ledge 98 formed around the periphery of the base assembly 30 when the lid is connected to the base.

Figure 7:
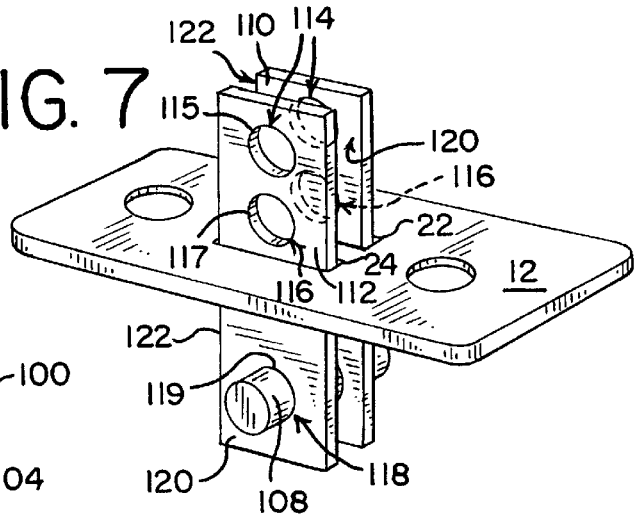
FIG. 7 is an isometric view showing the lid of the insert assembly of the present invention with positioning bars extending through the lid.
Figure 6:
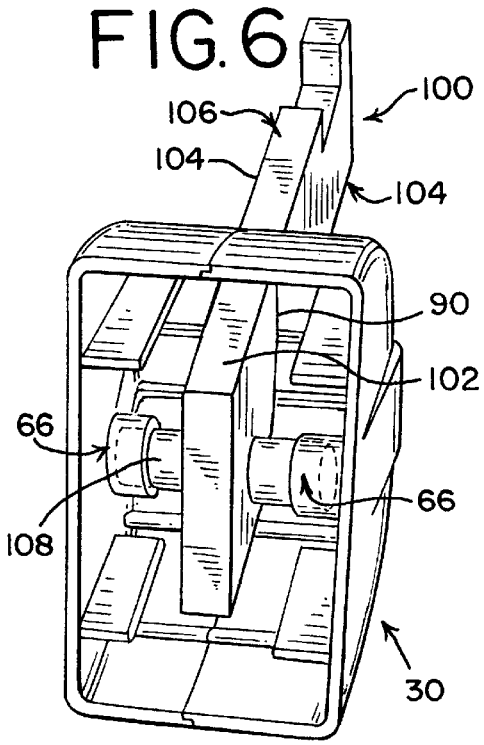
FIG. 6 is an isometric view of a lifting system as it would be associated with the insert of the present invention in a concrete panel to be cast, with the lid off for clarity.

Turning attention now to FIGS. 6 and 7, the insert assembly 10 will be described with respect to its complimentary use with a lifting system assembly 100. Such lifting systems have been disclosed by the present applicant in pending U.S. application Ser. No. 09/558,788, filed Apr. 26, 2000, which is hereby incorporated by reference into the present disclosure, in its entirety. As seen, the lifting system assembly 100 includes a rectangular member 102 that is formed from steel flat stock and which is situated within a cast concrete member (not shown) at least partially. The rectangular member 102 is referred to as an anchor-lifting device, and it includes the major opposed surfaces 104 and the minor opposed surfaces 106 (only one shown), along with the perpendicularly arranged lifting pin or rod 108 extending therethrough. The lifting pin 108 is of a diameter which is substantially the same diameter of arcuate bracket 66, which is essentially defined by interior surface 69 of wall 68.

The lifting system assembly 100 is initially inserted within the base assembly such that the lifting pin 108 is in contact against the interior surface 69 of arcuate bracket 66. Furthermore, the rectangular opening 90 that is formed in the base assembly 30 receives the rectangular flat stock member 102 such that major surfaces 104 contact against each of the long side walls 88, while the minor surfaces 106 of rectangular flat stock member 102 contact against each of the short side walls 86.

Positioning plates 110, 112 are used in certain applications where the base assembly 30 could be subject to movement while the concrete is setting up. Plates 110, 112 are formed with holes 114, 116 and 118, which are respectively delimited by edge surfaces 115, 117 and 119. The positioning plates each include major surfaces 120 and minor surfaces 122. Each plate 110 and 112 is inserted within a respective rectangularly-shaped slot 22 and 24 formed in lid 12 such that the major and minor surfaces 120, 122 contact the surfaces 23 and 25 which define the rectangular slots. From the three holes 114, 116 and 118 that are provided, one of them is chosen so that the positioning plates are inserted over the lifting pin 108 by insertion into the chosen hole. This is done prior to the lifting pin being inserted into the arcuate bracket 66. When the positioning plates are properly installed, the lid 12 is snap fitted onto the base assembly 30. The entire insert assembly 10 and lifting system assembly 100 is then ready for inclusion into a concrete panel member (not shown) that is about to be cast. The other two remaining holes 116 and 118 on each of the positioning plates 110, 112, are provided to receive a rather substantial bar member (not shown) which is used to hold the insert assembly 10 in a fixed position with respect to the mold of the precast panel member. The bar would extend across the frame of the mold so that the insert assembly 10 is held in a fixed position during the pouring of the concrete into the mold, such as when the insert is used along a side of the concrete form (as contrasted with simply resting on the top). By supporting the insert assembly in a fixed position, the lifting system assembly is also held fixed since it is coupled to the insert at the arcuate brackets 66.

The insert assembly 10 is preferably formed of a material which does not allow the concrete composition to adhere to the outside surfaces 38 and 46 of base assembly 30, such as a smooth-surfaced high-impact rigid plastic. Thus, after the concrete has been poured into the mold, it can be appreciated that the lid 12 protects the lifting system assembly 100 and prevents concrete from filling the interior space of base assembly 30. Once the concrete has set and cured, the lid 12 is removed and retained for future use. Secondly, the flaps 78 are pried upwards to free them in order to expose the set concrete that is now formed around the insert. The flaps are graspable, and can in some instances be used to pull the insert free. Otherwise, a pry bar can be inserted through the open flaps 78 to pry the entire base assembly 30 from the precast concrete member without destroying the insert assembly 10. Thus, it is a great cost savings that the lid and base assembly can be used again in another casting. In fact, the present invention allows the lid 12 to be used over almost indefinitely, while the base assembly 30 has been successfully tested in at least ten castings before reaching a state where it should be discarded.

While the apparatus and method herein disclosed form a preferred embodiment of this invention, this invention is not limited to those specific apparatus and methods, and changes can be made therein without departing from the scope of this invention which is defined in the appended claims.

What is claimed is:

1. An insert for placement within a mold used for forming a void space in a cast material, comprising:

a base assembly having an outside surface which forms the void space when positioned in the cast material before the cast material is set, said base assembly being comprised of a material which is non-destructively separable from the cast material when the cast material is set, said base assembly further having an interior space defined therein, an opening through said outside surface permitting access to said interior space, a left portion and a right portion that detachably connect to each other, said left portion and said right portion each including a respective wall bracket that extends horizontally into said interior space, each said wall bracket including a downward facing opening that is shaped and sized for receiving a respective end of a pin of a lifting hook assembly that is to be set into the cast material; and a lid that removably attaches to the base assembly, said lid protecting the interior space of the base assembly from entry of the cast material.

2. The insert of claim 1 wherein said lid snap-fits onto a peripheral ledge formed in the base assembly.

3. The insert of claim 2 wherein the base assembly includes a pair of movable flaps which move inboard relative to the interior space for assisting removal of the insert from the panel.

4. The insert of claim 2, wherein the lid is provided with a pair of spaced slots in communication with the interior spaces, each slot receiving a positioning member therethrough when the insert is to be set in the panel prior to casting.

5. An insert and lifting hook system for use in casting precast concrete panels, comprising:

a base assembly which forms a void in the concrete panels when positioned in the concrete panel before the concrete is set, said base assembly having an interior space and a bottom opening, said base assembly including a left portion and a right portion that detachably connect to each other, said left portion and said right portion each including a wall bracket that extends horizontally into said interior space, each said wall bracket including a downward facing opening;

a lifting hook assembly having a part received within said base assembly through said bottom opening, said part including a pin having a pair of ends, each said end being sized and shaped to be received within a respective one of said wall brackets through said downward facing opening; and a lid attached to said base assembly protecting said interior space of said base assembly and said lifting hook assembly from entry of concrete during casting, said lid having at least one slot defined therein adapted to receive a positioning member for orienting said base assembly relative to said lifting hook assembly.

6. An insert for creating a void space within a settable material which will form a solid product when set, with the void space surrounding an element embedded in the settable material, comprising:

a base member having an exterior surface which forms a void space when positioned in the settable material, and an interior space defined within said base member, said base member further having (i) a rectangular opening defined in said exterior surface adapted to receive the element therethrough with the element extending into said interior space, and (ii) an access opening defined in said exterior surface and through which said interior space is accessed to reach the element when the element is extending into said interior space, said base member including a left portion and a right portion that detachably connect to each other, said left portion and said right portion each including a respective wall bracket that extends horizontally into said interior space from a inner surface of a vertical sidewall thereof, each said wall bracket including a downward facing opening; and a cover over said access opening, said cover having a closed position wherein said interior space is generally inaccessible and an open position wherein said interior space is accessible.

7. The insert of claim 6 wherein said base member is reusable, being formed of with an exterior surface which is non-destructibly disengageable from the solid product formed from the settable material.

8. The insert of claim 6 wherein said base member is formed of substance which does not fixedly bond with the settable material along said exterior surface, said insert being non-destructibly removable from the solid product formed from the settable material.

9. The insert of claim 6 wherein the element is part of a lifting assembly which includes a rectangular member and a lifting rod extending generally perpendicular to a longitudinal axis of said rectangular member, said lifting rod being sized and shaped so as to be receivable in respective said wall brackets.

10. The insert of claim 9 wherein said lifting rod includes a radial diameter, said wall brackets having an arcuate shape yielding a concavity with a radius of curvature adapted to receive said lifting rod therein.

11. The insert of claim 10 wherein said cover further includes at least one slot defined therein, said slot adapted to receive a positioning plate used to locate said base member in place relative to the settable material, said positioning plate extending into said interior space through said slot and releasably engaging said lifting rod.

12. The insert of claim 9 wherein said cover further includes at least one slot defined therein, said slot adapted to receive a positioning plate used to locate said base member in place relative to the settable material.

13. The insert of claim 12 wherein said positioning plate extends into said interior space through said slot and releasably engages said lifting rod when said lifting rod is positioned within said interior space.

14. The insert of claim 6 wherein said exterior surface is defined in part by a base member sidewall which also defines in part said interior space, said base member sidewall further having a flap formed therein, said flap being hingedly connected to said base member sidewall and movable relative thereto into said interior space and said flap is adapted to yield a graspable flap which is accessible through said access opening to facilitate removal of said base member from the solid product.

* * * * *